US011341942B2

(12) United States Patent
Lee

(10) Patent No.: US 11,341,942 B2
(45) Date of Patent: May 24, 2022

(54) DESK FOR MUSIC EXPERT

(71) Applicant: Su Hyeok Lee, Seoul (KR)

(72) Inventor: Su Hyeok Lee, Seoul (KR)

( * ) Notice: Subject to any disclaimer, the term of this patent is extended or adjusted under 35 U.S.C. 154(b) by 156 days.

(21) Appl. No.: 16/934,027

(22) Filed: Jul. 21, 2020

(65) Prior Publication Data

US 2021/0035539 A1 Feb. 4, 2021

(30) Foreign Application Priority Data

Jul. 31, 2019 (KR) ..... 20-2019-0003191

(51) Int. Cl.
*G10G 5/00* (2006.01)
*A47B 21/03* (2006.01)

(52) U.S. Cl.
CPC ..... *G10G 5/005* (2013.01); *A47B 21/03* (2013.01); *A47B 2200/0084* (2013.01)

(58) Field of Classification Search
CPC ..... G10G 5/005; A47B 21/03; A47B 2200/0084; A47B 2021/0321; A47B 21/0314; A47B 2200/008
See application file for complete search history.

(56) References Cited

U.S. PATENT DOCUMENTS 6,206,495 B1 * 3/2001 Peterson ..... A47B 21/0314 312/283
2016/0143434 A1 * 5/2016 Cook ..... F16M 11/10 248/458

FOREIGN PATENT DOCUMENTS

| | | | |
|---|---|---|---|
| JP | 11503933 | A | 4/1999 |
| KR | 200313950 | Y1 | 5/2003 |
| KR | 200373241 | Y1 | 1/2005 |
| KR | 100726797 | B1 | 6/2007 |
| KR | 2020110002646 | U | 3/2011 |
| KR | 2020110005244 | U | 5/2011 |
| KR | 1020170032765 | A | 3/2017 |
| KR | 101904362 | B1 | 11/2018 |

* cited by examiner

*Primary Examiner* — Kimberly R Lockett

(57) ABSTRACT

Disclosed herein is a desk for a music expert, which is intended to improve the efficiency of the arrangement of music equipment used for various music tasks such as composition or arrangement, so that music work can be performed more comfortably. The present invention provides a desk for a music expert, the desk being configured such that a top plate (10) is supported at a predetermined height by support legs (30) and a sliding plate (20) is configured to selectively move forward and rearward in a horizontal direction under the top plate (10); wherein a keyboard (100) is seated on the sliding plate (20), and left and right sides of the sliding plate (20) are movably supported by guide rails (21); and wherein a center portion of the sliding plate (20) is supported by a center reinforcing rail (22) configured to prevent the sliding plate (20) from sagging.

3 Claims, 10 Drawing Sheets

DESK FOR MUSIC EXPERT

CROSS-REFERENCE TO RELATED APPLICATION

This application claims the benefit of Korean Patent Application No. 20-2019-0003191 filed on Jul. 31, 2019, which is herein incorporated by reference in its entirety.

TECHNICAL FIELD

The present invention relates to a desk for a music expert, and more particularly to a desk for a music expert that has improved convenience to allow music work to be performed more easily.

TECHNICAL BACKGROUND

In general, desks are configured such that the top plates thereof are placed at predetermined heights so that they are disposed and used in front of users when the users read books, write documents, or do office works. Such desks are pieces of all-in-one furniture that are standardized in large, medium, and small sizes in terms of their composition and size, and are widely used in general homes and offices.

However, music experts who specialize in composition or arrangement should use electronic keyboards as well as computers. When a keyboard having a predetermined length is placed on such a desk, it occupies a large area of the desk and the height of the keyboard is not suitable for playing. As a result, a burden is placed on the wrists of a performer, so a disease such as tendosynovitis is likely to occur, and there is insufficient space to place a computer monitor and speakers.

Meanwhile, recently, computer desks for facilitating computer work have been popularized. As a conventional example of such a computer desk, Korean Utility Model Registration No. 373241 discloses a technology related to a computer desk equipped with a monitor lifting/lowering function as well as a slidable keyboard drawer.

However, in the conventional computer desk, the keyboard drawer is limited in width. Furthermore, the support capacity of the keyboard drawer is low. Accordingly, when a keyboard shelf, which is a weight body, is placed, a problem arises in that the keyboard drawer is easily bent or damaged by a load.

PRIOR ART DOCUMENTS

Patent Documents (Patent document 1) Korean Utility Model Registration No. 373241 (registered on Jan. 1, 2005)

(Patent document 2) Korean Patent No. 726797 (registered on Jun. 4, 2007)

SUMMARY

The present invention has been conceived to overcome the above-described problems, and an object of the present invention is to provide to develop and provide a desk for a music expert having a functional structure, which allows a music expert who professionally performs composition or arrangement work to perform music work more conveniently.

In order to accomplish the above object, the present invention provides a desk for a music expert, the desk being configured such that atop plate is supported at a predetermined height by support legs and a sliding plate is configured to selectively move forward and rearward in a horizontal direction under the top plate; wherein a keyboard is seated on the sliding plate, and the left and right sides of the sliding plate are movably supported by guide rails; and wherein the center portion of the sliding plate is supported by a center reinforcing rail configured to prevent the sliding plate from sagging.

Furthermore, the guide rails on both sides are supported by support frames, the support frames are fastened and coupled to the support legs, and a plurality of adjusting holes configured to variably adjust the locations at which the support frames are fastened is formed in the support legs at predetermined intervals so that the height of the sliding plate is adjusted.

BRIEF DESCRIPTION OF DRAWINGS

The above and other objects, features, and advantages of the present invention will be more clearly understood from the following detailed description taken in conjunction with the accompanying drawings, in which.

EMBODIMENTS

Figure 1:
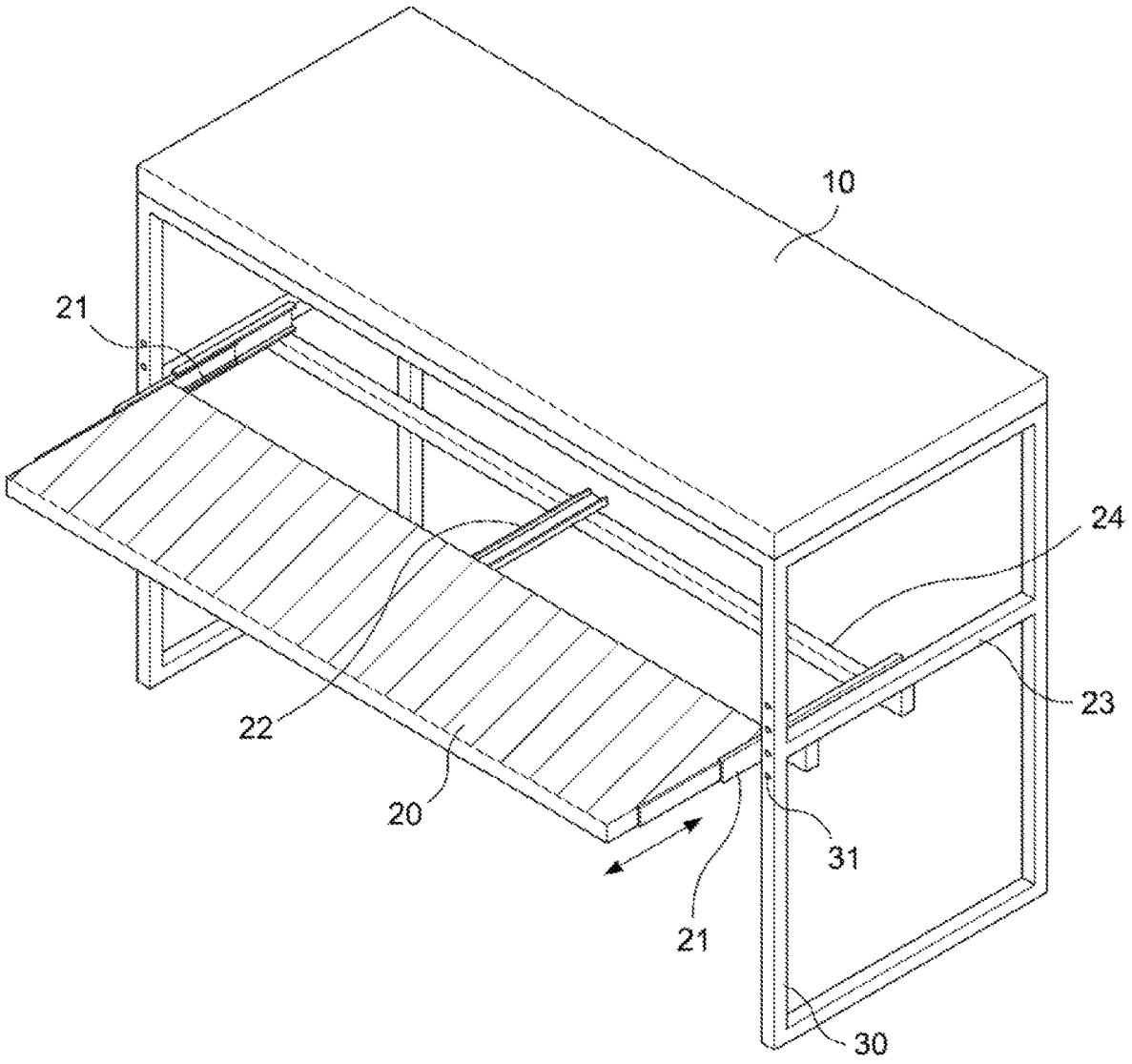
FIG. 1 is a perspective view of a desk for a music expert according to a first embodiment of the present invention.
Figure 2:
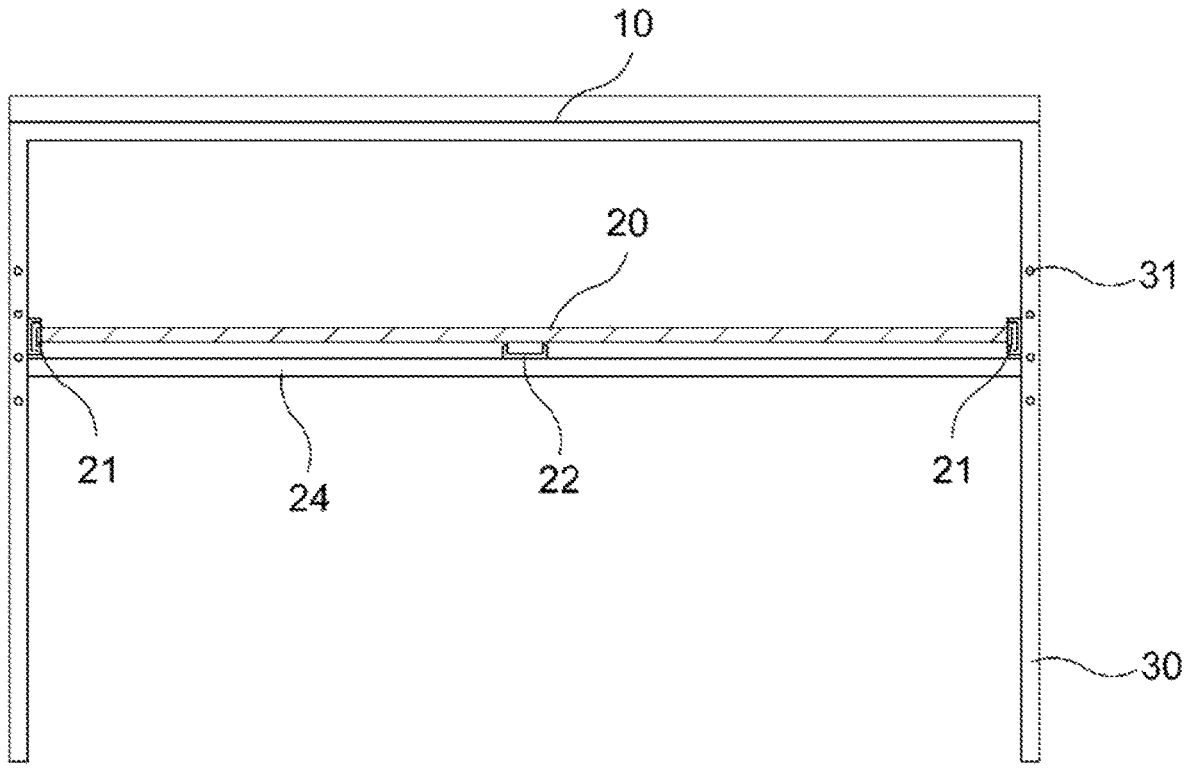
FIG. 2 is a front view of the structure of the desk for a music expert according to the first embodiment.
Figure 3:
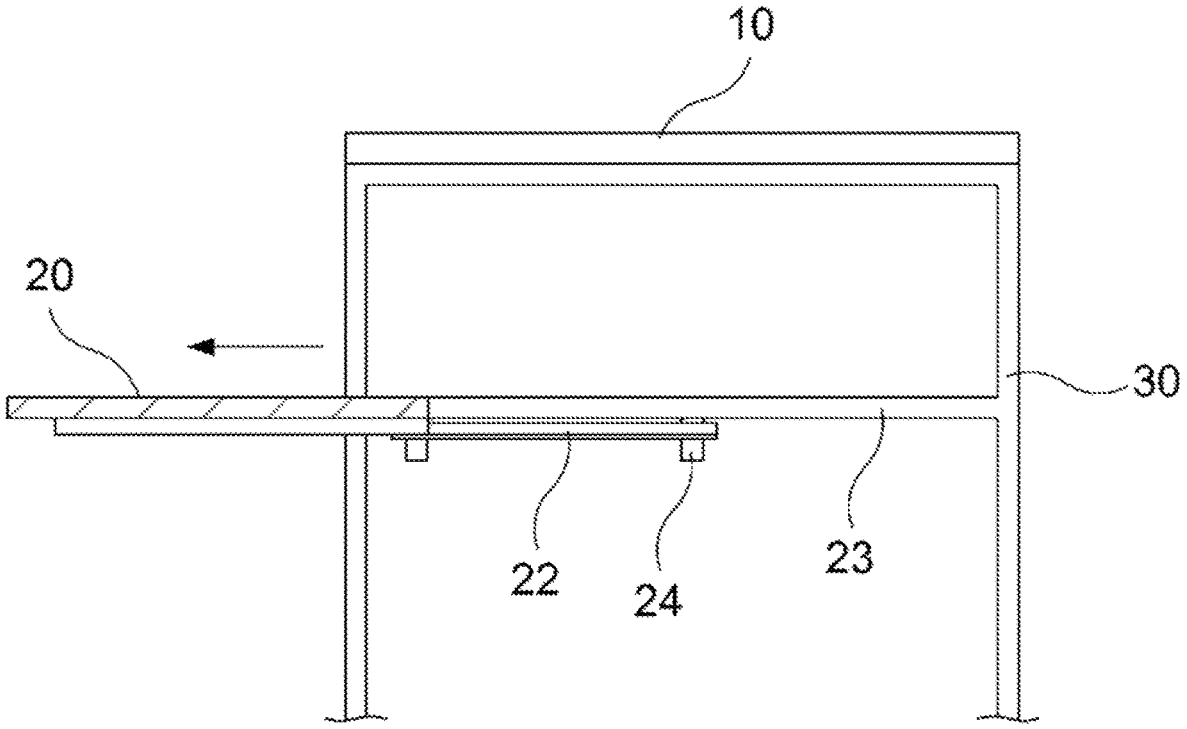
FIG. 3 is a sectional view of a state in which a sliding plate is pulled out of the desk for a music expert according to the first embodiment.
Figure 4:
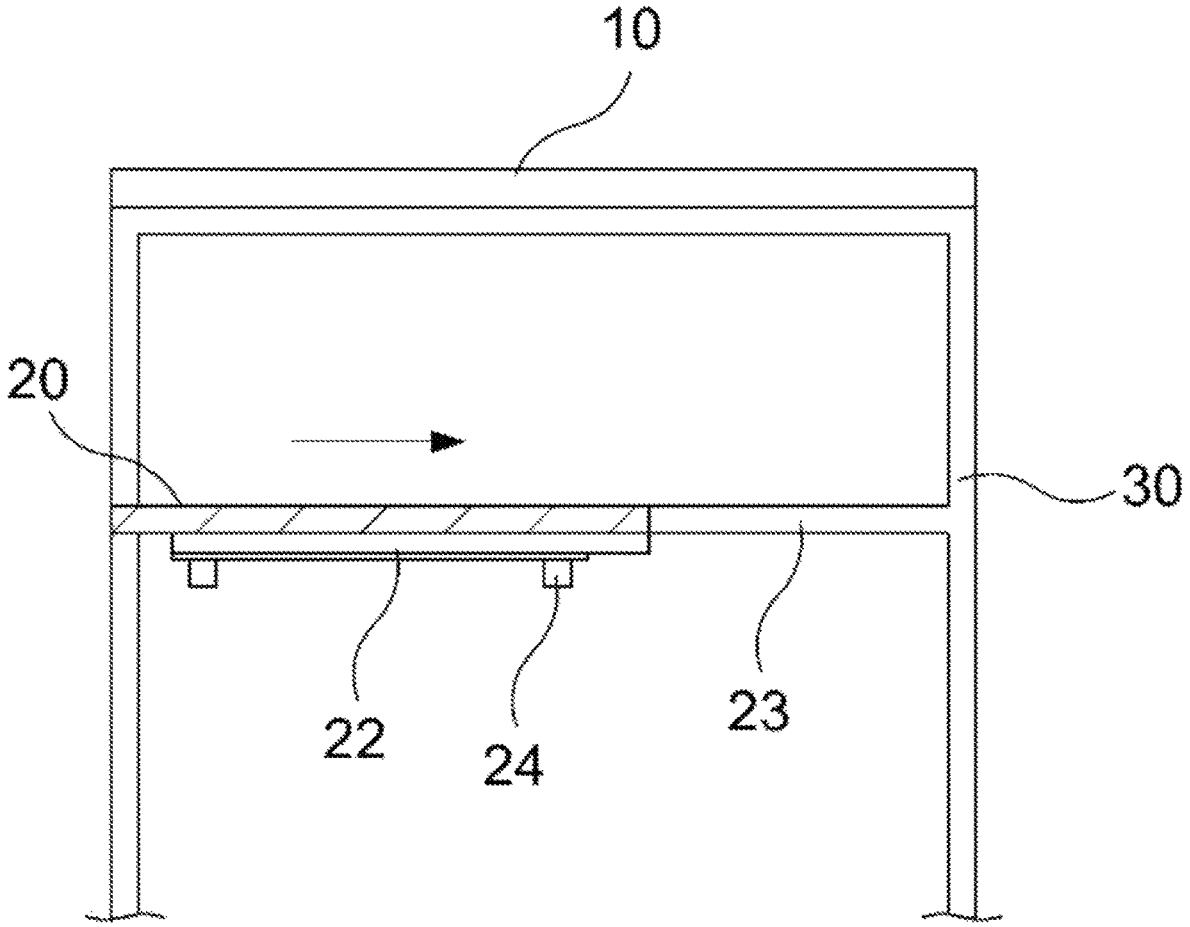
FIG. 4 is a sectional view of a state in which the sliding plate is retracted into the desk for a music expert according to the first embodiment.

Specific embodiments of the present invention will be described in detail below with reference to the accompanying drawings.

The embodiments of the present invention may be modified in various forms, and the scope of the present invention should not be interpreted as being limited to the embodiments described in detail below. The present embodiments are provided to more fully describe the present invention to those skilled in the art.

Accordingly, the shapes and patterns of components illustrated in the drawings may be exaggerated to emphasize a more clear description. It should be noted that the same components may be designated by the same reference numerals throughout the drawings. Furthermore, a detailed description of the function and configuration of a known technology that is determined to unnecessarily obscure the gist of the present invention will be omitted.

First, the configuration of a desk for a music expert according to a first embodiment of the present invention will be described with reference to FIGS. 1 to 4, as follows.

In the desk according to the present embodiment, a top plate 10 is supported at a predetermined height by support legs 30, and a sliding plate 20 is configured to selectively move forward and rearward in a horizontal direction under the top plate 10.

In particular, a keyboard 100 is seated on the sliding plate 20, the left and right sides of the sliding plate 20 are movably supported by guide rails 21, and the center portion of the sliding plate 20 is supported by a center reinforcing rail 22 configured to prevent the sliding plate 20 from sagging.

Furthermore, it may be seen that each of the four support legs 30 has a plurality of adjusting holes 31 configured to adjust the height of the sliding plate 20 or guide rails 21 at predetermined height intervals.

In the present embodiment, the configuration of the guide rails 21 on both sides of the sliding plate 20 is the same as that of guide rails applied to a typical sliding drawer, and thus a detailed description of the configuration will be omitted.

In the drawings, reference symbol 23 designates support frames configured to support both sides of the sliding plate 20, and reference symbol 24 designates a reinforcing frame configured to connect the two side support frames 23 and to allow the reinforcing rail 22 to be seated thereon.

Accordingly, the sliding plate 20, the guide rails 21, the center reinforcing rail 22, the support frames 23, and the reinforcing frame 24 form a single integrated assembly structure, and allows the height at which the sliding plate 20 is installed to be adjusted through the adjustment of the location at which the adjusting holes 31 formed in the support legs 30 and the support frames 23 are fastened to each other.

The operation of the desk for a music expert according to the present invention, which is configured as described above, will be described below.

Figure 5:
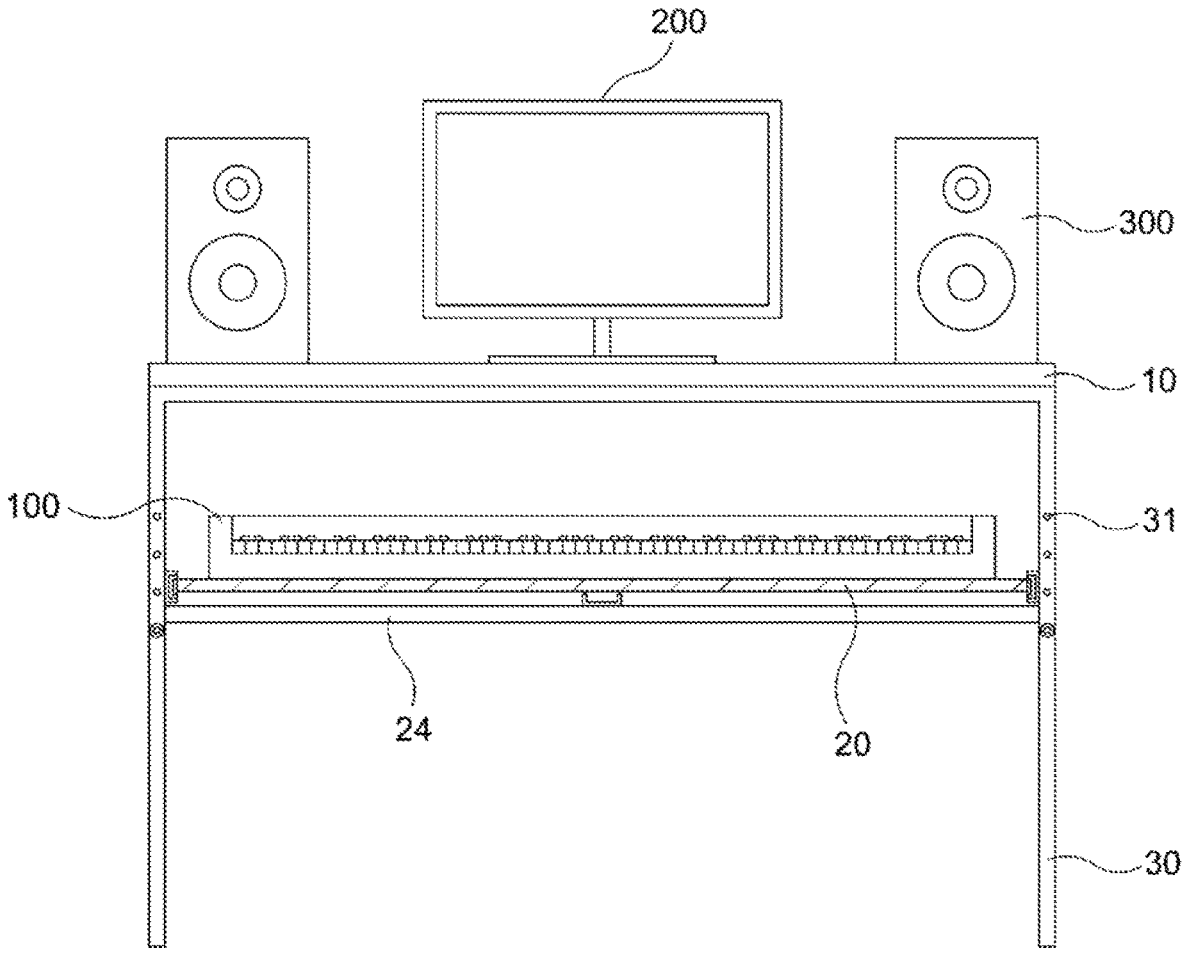
FIG. 5 is a front view of a state in which the desk for a music expert according to the first embodiment is used.
Figure 6:
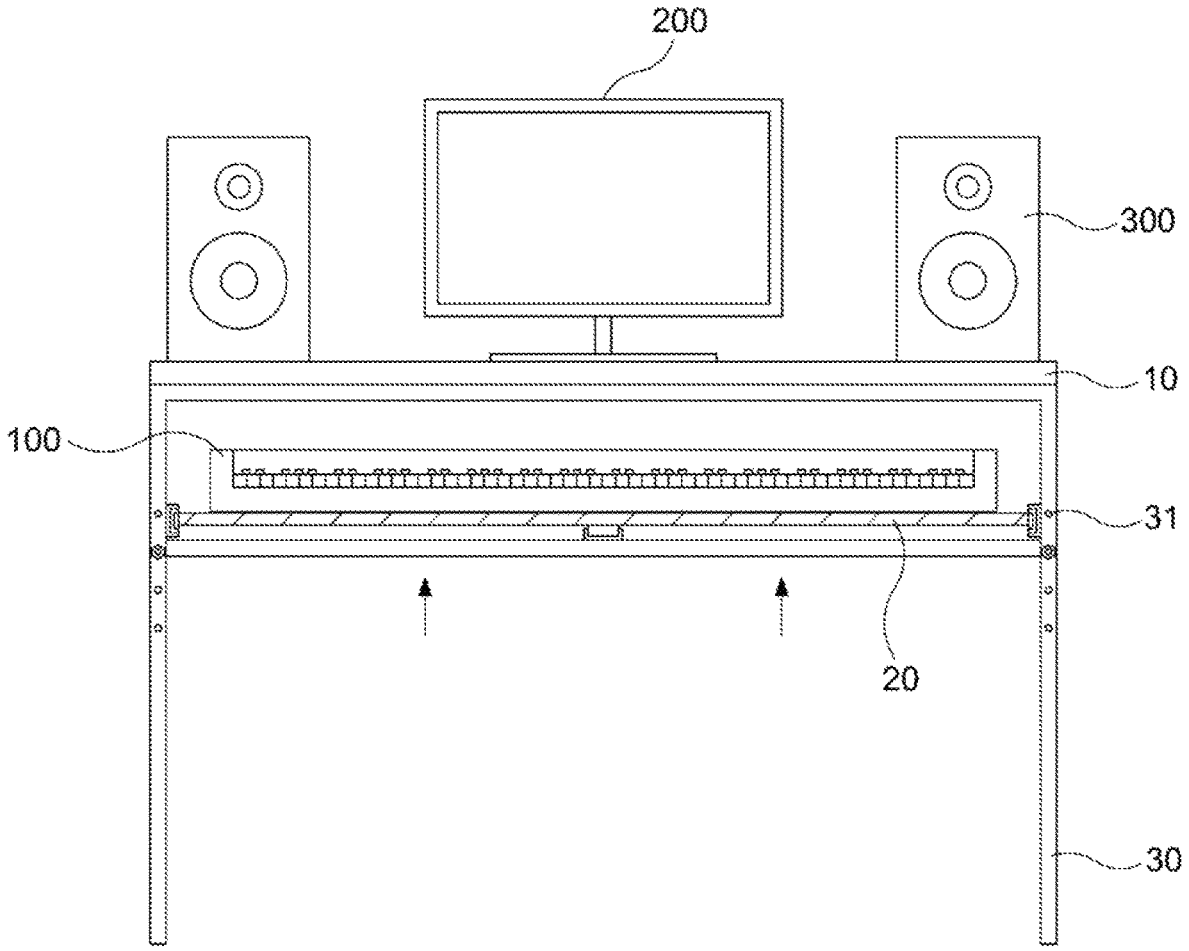
FIG. 6 is a view of a state in which the height of the sliding plate is adjusted in the desk for a music expert according to the first embodiment is used.

Music work is performed on the desk according to the present invention, with a monitor 200 and speakers 300 being disposed on the top plate 10 and the keyboard 100 being placed on the sliding plate 20, as shown in FIG. 5.

In this case, the sliding plate 20 on which the keyboard 100 is placed may selectively slide forward and rearward while both sides of the sliding plate 20 are supported by the guide rails 21. The center reinforcing rail 22 may be additionally disposed on the sliding plate 20, and may thus prevent the sliding plate 20 from sagging due to the load of the keyboard 100.

In other words, when the sliding plate 20 is pulled out, the load of the keyboard 100, which is a weight body, is concentrated on the front side of the sliding plate 20. In this case, it can be seen that stable load bearing may be achieved due to the center reinforcing rail 22.

Furthermore, the height of the sliding plate 20 may be adjusted using the plurality of adjusting holes 31 formed along the height of the support legs 30. Accordingly, it can be seen that the keyboard 100 may be placed and used on the sliding plate 20 in the state in which the sliding plate 20 has been adjusted to an optimum height according to the physical characteristics of a user.

In other words, in the state in which the support frames 23 are assembled to the adjusting holes 31 of the support legs 30 by piece fastening, the sliding plate 20 and the reinforcing frame 24 may be adjusted up or down together by adjusting a piece fastening location for the adjusting holes 31.

Accordingly, in the desk according to the present invention, the draw-type sliding plate on which a keyboard is seated forms a stable load-bearing structure, and thus a sagging or leaning phenomenon attributable to the weight of the keyboard is prevented, thereby providing an effect in that a music expert may perform music work more conveniently.

Furthermore, since it may be possible to adjust the height of the sliding plate, it may be possible to adjust the height of the sliding plate to an optimum height in order to fit the physical characteristics of a user no matter whether the height of a keyboard varies depending on a musical instrument.

Figure 7:
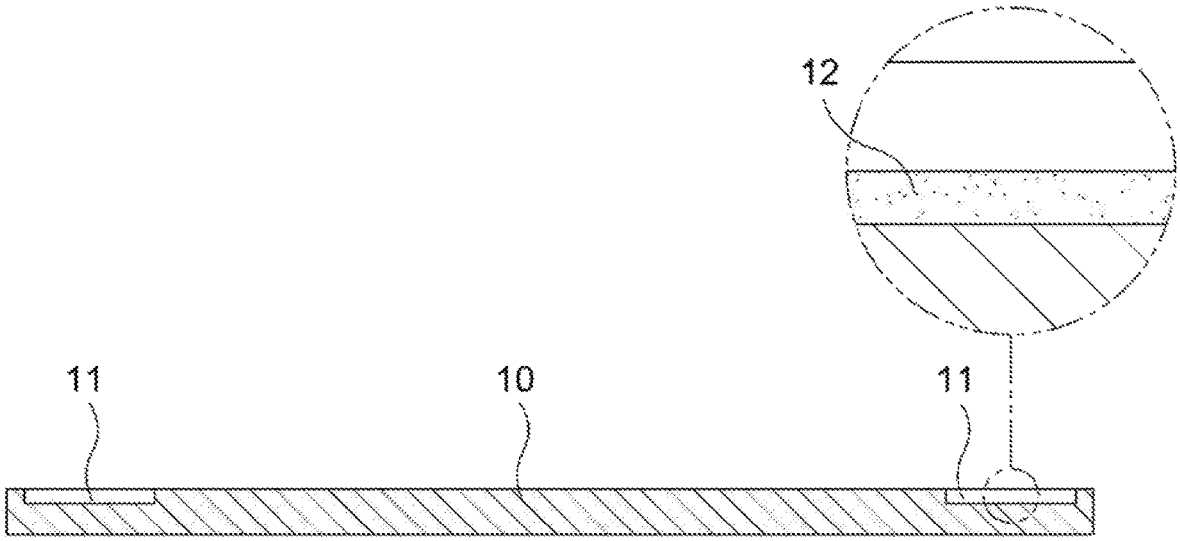
FIG. 7 is a sectional view of the structure of the top plate of a desk for a music expert according to a second embodiment of the present invention.

Meanwhile, FIG. 7 shows a configuration according to a second embodiment of the present invention. Referring to this drawing, speaker seating depressions 11 configured to allow speakers 300 to be seated therein are formed in a top plate 10, and shock-absorbing pads 12 configured to absorb vibrations related to the speakers 300 are provided in the speaker seating depressions 11.

When the above-described configuration is provided, the speakers 300 are seated in the speaker seating depressions 11 formed in the top surface of the top plate 10. Accordingly, even when an external shock is transferred to a desk, the speakers 300 are prevented from being moved or collapsed and a stable seating and support state may be maintained.

In particular, the shock-absorbing pads 12 serve to absorb vibrations generated in the speakers 300, thereby providing the advantage of preventing the desk from being shaken.

Figure 8:
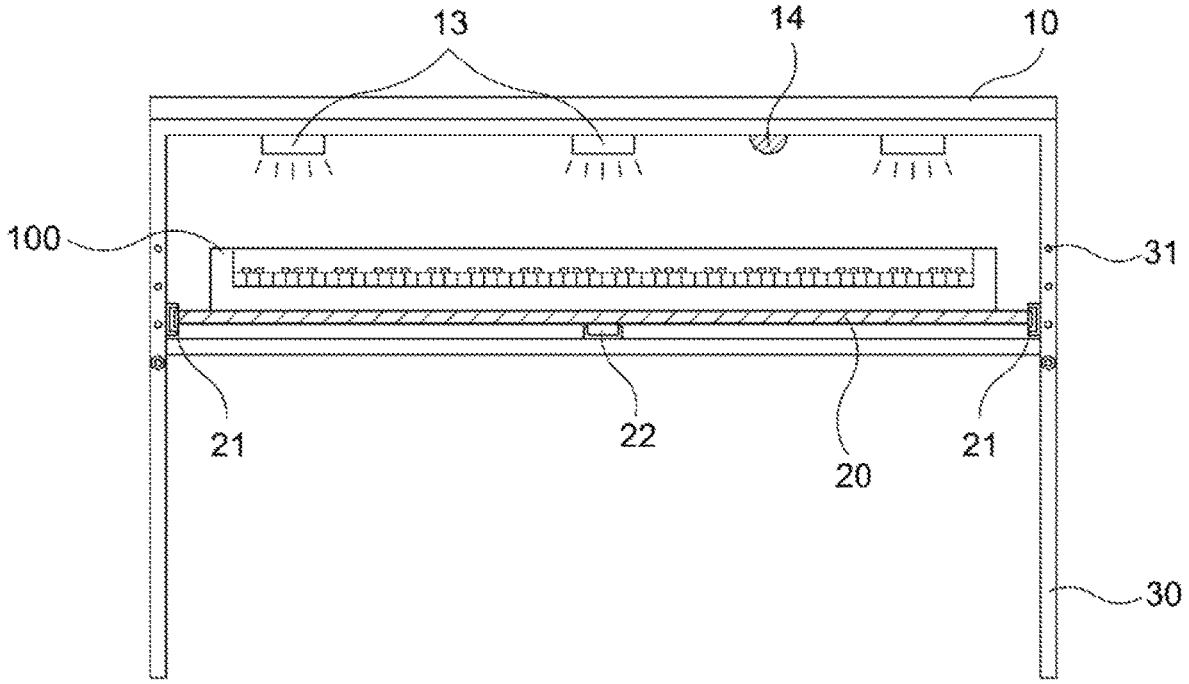
FIG. 8 is a front view of the structure of a desk for a music expert according to a third embodiment of the present invention.
Figure 9:
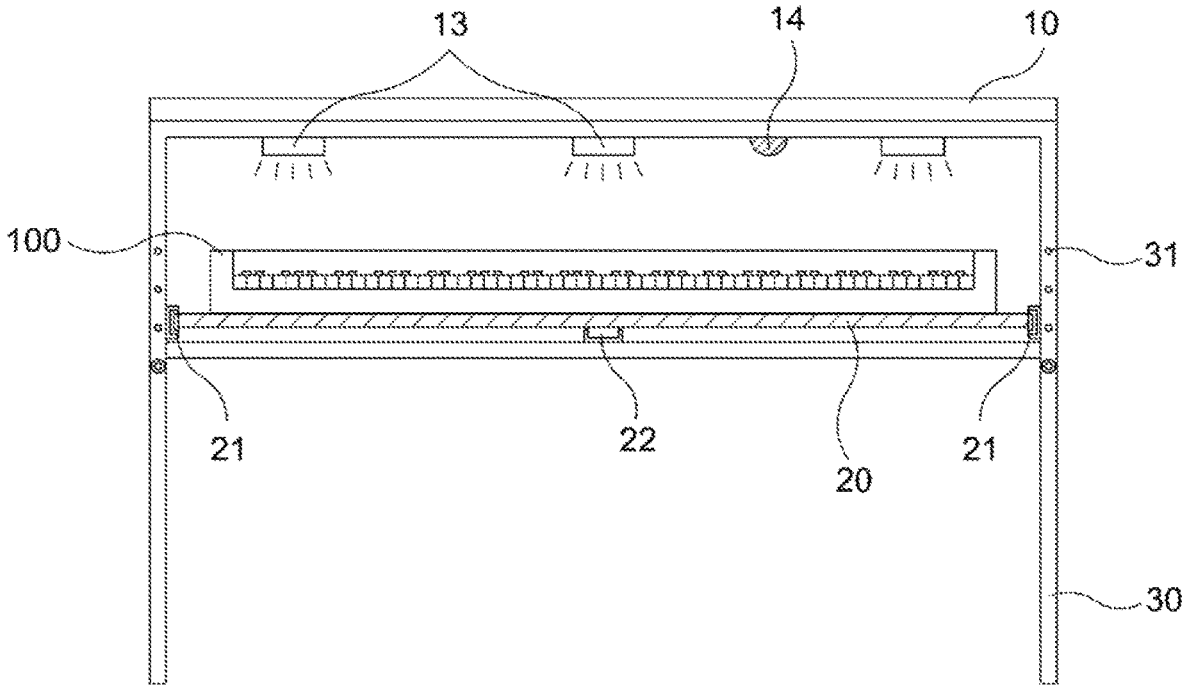
FIG. 9 is a view of the operation of sterilizing a keyboard in the desk for a music expert according to the third embodiment.

Furthermore, FIGS. 8 and 9 show a configuration according to a third embodiment of the present invention. Referring to this drawing, sterilization lamps 13 configured to sterilize a keyboard 100 seated on a sliding plate 20 are disposed on the bottom surface of a top plate 10, and a sensor 14 configured to control the operation of the sterilization lamps 13 based on the detection of the keyboard 100 is provided on one side of the bottom surface.

When the above-described configuration is provided, the sensor 14 cannot detect the keyboard 100 under the top plate 10 in the state in which the sliding plate 20 is pulled out, it stops the operation of the sterilization lamps 13. In contrast, when the sliding plate 20 is retracted and the keyboard 100 is detected, the sterilization lamps 13 are operated for a predetermined period of about 5 to 10 minutes and thus sterilize the keyboard.

Accordingly, in the process of storage after use, the sterilization of the keyboard is automatically performed, and thus the hygienic and efficient management of the keyboard 100 may be achieved.

Figure 10:
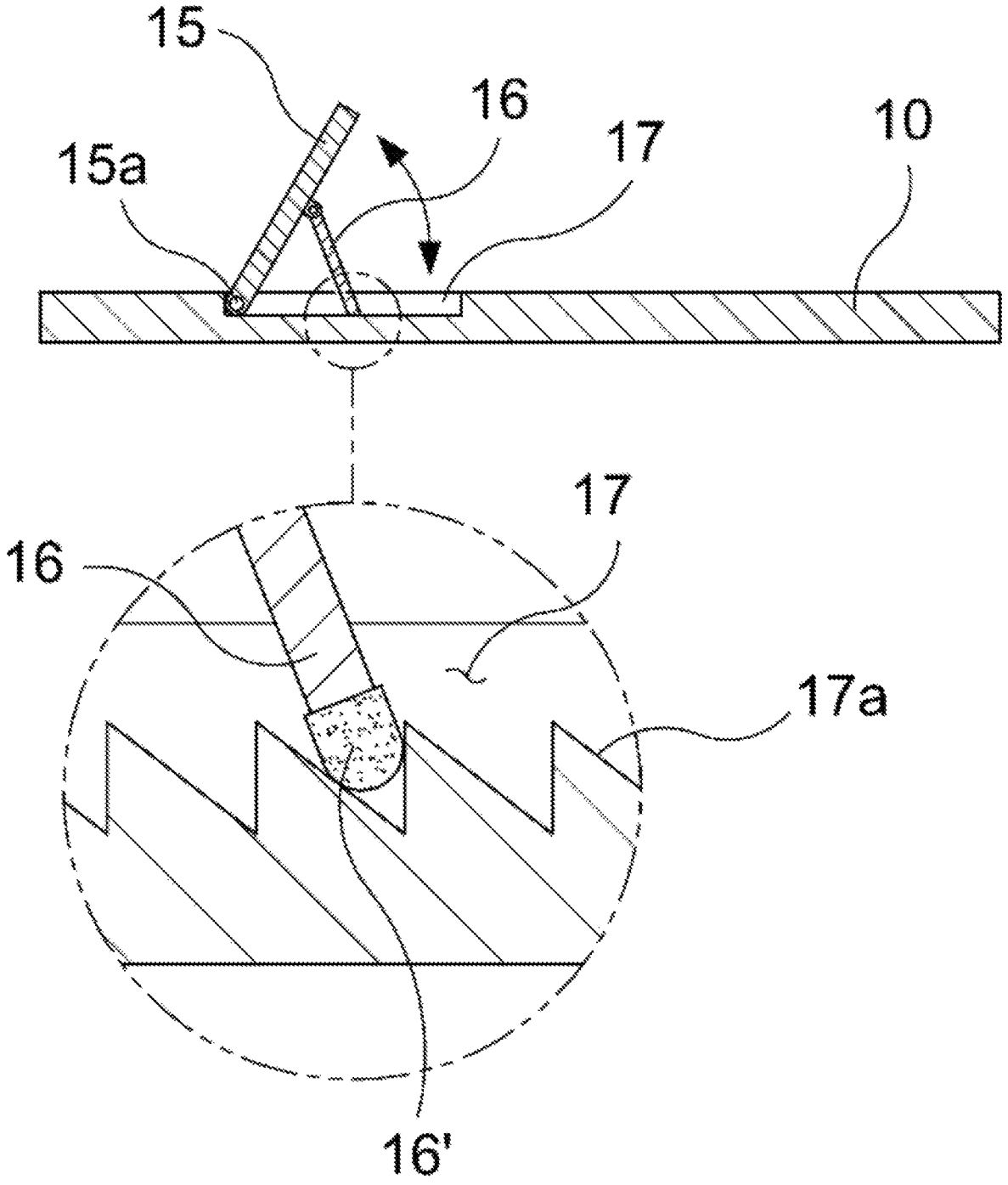
FIG. 10 is a sectional view of the structure of the top plate of a desk for a music expert according to a fourth embodiment of the present invention.

Furthermore, FIG. 10 shows a configuration according to a fourth embodiment of the present invention. Referring to this drawing, a music stand 15 is installed in a top plate 10 by a hinge pin 15*a* to support a sheet of music, an angle adjuster 16 is foldably disposed on the back surface of the music stand 15, and a storage depression 17 is formed in the top plate 10 such that the music stand 15 is stored therein.

Furthermore, a saw-toothed portion 17*a* is formed on the bottom surface of the storage depression 17 so that the lower end of the angle adjuster 16 is caught on the saw-toothed portion 17*a*. A shock-absorbing rubber 16' is integrated with the lower end of the angle adjuster 16 in order to reduce impact with the saw-toothed portion 17*a* and increase frictional force.

When the above-described configuration is provided, the music stand 15 is normally laid down in the storage depression 17. When it is necessary to view a sheet of music, the music stand 15 is erected and then used.

In particular, the angle adjuster 16 is configured such that the lower end thereof is caught on the saw-toothed portion 17*a*, and thus the support angle of the music stand 15 may be variably adjusted as needed.

Furthermore, as the frictional force with the saw-toothed portion 17*a* is increased due to the shock-absorbing rubber 16', a shock-absorbing action is performed, and thus the stable angle adjustment of the music stand 15 is achieved.

Furthermore, although the specific embodiments of the present invention have been described and illustrated, it is obvious that the desk for a music expert according to the present invention may be modified and practiced in various forms.

For example, in the above embodiment, a state in which one central reinforcing rail is illustrated as being installed, but two or more central reinforcing rails may be installed to increase the load-bearing capacity of the sliding plate.

In the desk according to the present invention, the drawer-type sliding plate on which the keyboard is seated forms a stable load-bearing structure, and thus sagging and damage attributable to the weight of the keyboard are prevented, thereby providing an effect in that music work may be performed more conveniently.

Furthermore, it may be possible to adjust the height of the sliding plate, and thus it may be possible to adjust the height of the sliding plate to an optimum height in order to fit the physical characteristics of a user no matter whether the height of a keyboard varies depending on a musical instrument.

Therefore, such modified embodiments should not be individually understood from the technical spirit or scope of the present invention, and such modified embodiments should be included in the attached claims of the present invention.

What is claimed is:

1. A desk for a music expert, the desk being configured such that a top plate (10) is supported at a predetermined height by support legs (30) and a sliding plate (20) is configured to selectively move forward and rearward in a horizontal direction under the top plate (10);

wherein a keyboard (100) is seated on the sliding plate (20), and left and right sides of the sliding plate (20) are movably supported by guide rails (21);

wherein a center portion of the sliding plate (20) is supported by a center reinforcing rail (22) configured to prevent the sliding plate (20) from sagging;

wherein the guide rails (21) on both sides are supported by support frames (23), the support frames (23) are fastened and coupled to the support legs (30), and a plurality of adjusting holes (31) configured to variably adjust locations at which the support frames (23) are fastened is formed in the support legs (30) at predetermined intervals so that a height of the sliding plate (20) is adjusted; and wherein speaker seating depressions (11) configured to allow speakers (300) to be seated therein are formed in the top plate (10), and shock-absorbing pads (12) configured to absorb vibration related to the speakers (300) are provided in the speaker seating depressions (11).

2. The desk of claim 1, wherein a sterilization lamp (13) configured to sterilize a keyboard (100) seated on the sliding plate (20) is disposed on a bottom surface of the top plate (10) and a sensor (14) configured to control an operation of the sterilization lamp (13) based on detection of the keyboard (100) is provided on one side of the bottom surface, so that when the sliding plate (20) is pulled out, the keyboard (100) is not detected by the sensor (14) and thus the sterilization lamp (13) is not operated, and when the sliding plate (20) is retracted, the keyboard (100) is detected by the sensor (14) and the sterilization lamp (13) is operated for a predetermined period.

3. The desk of claim 1, wherein a music stand (15) is installed in the top plate (10) by a hinge pin (15*a*) to support a sheet of music, an angle adjuster (16) is foldably disposed on a back surface of the music stand (15), a storage depression (17) is formed in the top plate (10) such that the music stand (15) is stored therein, a saw-toothed portion (17*a*) is formed on a bottom surface of the storage depression (17) so that a lower end of the angle adjuster (16) is caught on the saw-toothed portion (17*a*), and a shock-absorbing rubber (16') is integrated with the lower end of the angle adjuster (16) in order to reduce impact with the saw-toothed portion (17*a*) and increase frictional force.

* * * * *